US009844787B2

(12) United States Patent
Zhou et al.

(10) Patent No.: US 9,844,787 B2
(45) Date of Patent: Dec. 19, 2017

(54) SHOWER HEAD WITH ALTERNATING OUTLET FUNCTION

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Huasong Zhou, Xiamen (CN); Yangfeng Ji, Xiamen (CN); Jianmin Chen, Xiamen (CN); Yuanfang Huang, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 3 days.

(21) Appl. No.: 14/365,232

(22) PCT Filed: Nov. 27, 2012

(86) PCT No.: PCT/CN2012/085333

§ 371 (c)(1),
(2) Date: Jun. 13, 2014

(87) PCT Pub. No.: WO2013/091464

PCT Pub. Date: Jun. 27, 2013

(65) Prior Publication Data

US 2014/0326805 A1 Nov. 6, 2014

(30) Foreign Application Priority Data

Dec. 20, 2011 (CN) ..... 2011 1 0430223

(51) Int. Cl.
*A62C 31/02* (2006.01)
*B05B 1/18* (2006.01)
(Continued)

(52) U.S. Cl.
CPC ..... *B05B 1/185* (2013.01); *B05B 1/12* (2013.01); *B05B 1/18* (2013.01); *B05B 3/04* (2013.01)

(58) Field of Classification Search
CPC .. B05B 1/185; B05B 1/12; B05B 1/18; B05B 3/04
(Continued)

(56) References Cited

U.S. PATENT DOCUMENTS 4,398,669 A * 8/1983 Fienhold ..... 239/447
4,944,457 A * 7/1990 Brewer ..... 239/242
(Continued)

FOREIGN PATENT DOCUMENTS

CN 2633428 Y 8/2004
CN 101773880 A 7/2010
(Continued)

*Primary Examiner* — Arthur O Hall
*Assistant Examiner* — Adam J Rogers
(74) *Attorney, Agent, or Firm* — Rabin & Berdo, P.C.

(57) ABSTRACT

A shower head with alternating outlet function, includes: an inlet waterway with an inlet port, an outlet port, a waterway, an outlet terminal having at least two mutually independent outlet cavities rotatably distributed on a plane, and all have outlet holes, alternating inlet holes and synchronous inlets; the outlet holes are disposed on the outlet surface of the shower head; and an alternating cavity with alternating inlets, fixed to the outlet terminal. The alternating cavity is connected to all alternating inlet holes. The interior thereof is disposed with a hydraulic alternating device to make the alternating inlets to connect to the alternating inlet holes in alternating manner driven by water pressure. The synchronous inlets and the alternating inlets are switched to connect to the outlet port by a water diversion plate.

9 Claims, 5 Drawing Sheets

(51) Int. Cl.
*B05B 1/12* (2006.01)
*B05B 3/04* (2006.01)

(58) Field of Classification Search
USPC ..... 239/390
See application file for complete search history.

(56) References Cited

U.S. PATENT DOCUMENTS

| | | | | |
|---|---|---|---|---|
| 5,577,664 | A * | 11/1996 | Heitzman | 239/99 |
| 5,862,985 | A * | 1/1999 | Neibrook | B05B 1/1636 239/428.5 |
| 6,412,711 | B1 | 7/2002 | Fan | |
| 8,905,332 | B2 * | 12/2014 | Luettgen | B05B 1/1654 239/222.11 |
| 2006/0102747 | A1 * | 5/2006 | Ho | B05B 1/18 239/383 |
| 2008/0156897 | A1 * | 7/2008 | Leber | B05B 3/04 239/101 |
| 2010/0065665 | A1 * | 3/2010 | Whitaker | B05B 1/1636 239/562 |
| 2011/0215171 | A1 * | 9/2011 | Chen et al. | 239/237 |
| 2012/0181353 | A1 * | 7/2012 | Zhou et al. | 239/101 |

FOREIGN PATENT DOCUMENTS

| | | | |
|---|---|---|---|
| CN | 102527529 | A | 7/2012 |
| CN | 202447214 | U | 9/2012 |
| JP | 2001070837 | A | 3/2001 |

* cited by examiner

SHOWER HEAD WITH ALTERNATING OUTLET FUNCTION

FIELD OF THE INVENTION

The present invention relates to a shower head device, especially to a shower head with alternating outlet function.

BACKGROUND OF THE INVENTION

An improvement in a shower head is to make the outside with alternating discharging effect, that is to say, in original condition, all outlet holes of the outlet surface discharge water synchronously, it changes to that only a part of outlet holes discharge water at each time point, the remainders keep off, as time goes on, the several parts alternately discharge water. Basically, it needs some features to realize the function: when alternating discharging, the conditions of switching on and off are obvious, so thus making it with strong pause and easy to realize massage effect; the whole outlet surface is alternating discharging water, but not limited to a part of outlet holes; the whole outlet surface of the shower head is switched automatically between synchronous outlet and alternating outlet; the structure of device is applicable with different alternating proposal; it needs less components and it is reliable and simple structural.

In general, the structure is usually complicated to realize the whole outlet surface with automatically alternating outlet, and it needs many components; therefore, with regard to the present needs, existing technology can not take above effects into count.

SUMMARY OF THE INVENTION

The present invention is provided with a shower head with alternating outlet function to solve the technical problems of existing technology, the technical proposal of the present invention is:

A shower head with alternating outlet function comprising:

an inlet waterway, comprising an inlet port, an outlet port and an entire waterway therebetween;

an outlet terminal, having at least two outlet cavities, the outlet cavities are rotatably distributed on a plane and being mutually independent, and the outlet cavities have outlet holes, alternating inlet holes and synchronous inlets; the outlet holes are disposed on an outlet surface of the shower head; and an alternating cavity with alternating inlets, fixed to the outlet terminal; the alternating cavity is connected to all alternating inlet holes; the interior thereof is disposed with a hydraulic alternating device to make the alternating inlets to connect to the alternating inlet holes in alternating manner driven by water pressure;

thereinto, the synchronous inlets and the alternating inlets are switched to connect to the outlet port by a water diversion plate; the water diversion plate has a structure that when the alternating inlets are connected to the outlet port, the synchronous inlets are mutually separated and sealed.

In another preferred embodiment, the water diversion plate is rotatably coupled to the outlet port.

In another preferred embodiment, the synchronous inlets and the alternating inlets are located on an top surface of the water diversion plate, the top surface is slidably coupled to the outlet port.

In another preferred embodiment, the synchronous inlets and the alternating inlets are distributed on a same revolution surface in circumference, the synchronous inlet, the alternating inlets and the outlet port are rotatably symmetrical about the rotation axis of the outlet port.

In another preferred embodiment, the outlet cavities are rotatably symmetrical; the alternating cavity, the water diversion plate and the outlet cavities are coaxial.

In another preferred embodiment, the alternating inlet holes of the outlet cavities are centered on the central shaft thereof; the synchronous inlets of the outlet cavities are distributed in the external periphery of the alternating inlet holes in circumference.

In another preferred embodiment, the hydraulic alternating device comprising an impeller rotating by the impact of the flow-in water from the alternating inlets, the impeller is alternately coupled to the inlet holes of the outlet cavities by a speed reducer driving a water stop blade to rotate.

In another preferred embodiment, the speed reducer is a planetary gear train.

In another preferred embodiment, the planetary gear train comprising:

a sun gear fixed to the central shaft of the impeller;

three planetary gears engaged to the external periphery of the sun gear uniformly, the rotation shafts of the three planetary gears are disposed to the water stop blade; and a gear frame with an internal annular gear, engaged to the external peripheries of all gears; the gear frame is fixed to the internal wall of the alternating cavity.

In another preferred embodiment, it comprises two outlet cavities, the synchronous inlets thereof are distributed in the external periphery of the alternating inlet holes in circumference, two outlet areas correspondingly disposed.

In another preferred embodiment, it comprises three outlet cavities, the synchronous inlets thereof are distributed in the external periphery of the alternating inlet holes in circumference, three outlet areas are correspondingly disposed.

In another preferred embodiment, it comprises four outlet cavities, the synchronous inlets thereof are distributed in the external periphery of the alternating inlet holes in circumference, four outlet areas are correspondingly disposed.

Compared to the existing technology, the present invention has advantages as below:

1. the outlet holes of the whole shower head are alternatively switched to alternating outlet or integral outlet; the synchronous inlets and the alternating inlets of the water diversion plate, when connecting to the outlet port, are mutually individual, so that the waterway switch is obvious and clear, the water flowing has strong pause effect. In addition, it has simple structure and less components; the structure is easy to expend the alternating units.
2. the synchronous inlets and the alternating inlets of the water diversion plate are rotatably coupled to the outlet port, the switch operation is realized by only a rotation in a certain angle forward or backward, it operates conveniently.
3. the alternating inlet holes are centered on the center of outlet cavity, so that the water stop blade is switched with less labor and quiet, the device is compact structural.
4. The hydraulic alternating device is applied with speed reducer with three symmetrical planetary gears, the switch torque and the rotation speed are stable, it operates with quiet.

BRIEF DESCRIPTION OF THE DRAWINGS

The present invention will be further described with the drawings and the embodiments.

DETAILED DESCRIPTION OF THE EMBODIMENTS

Figure 1:
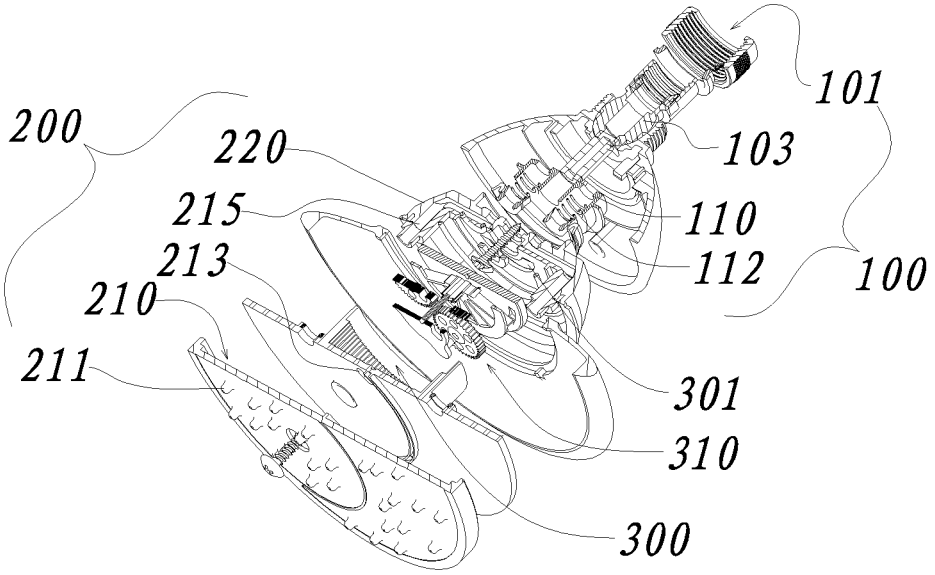
FIG. 1 illustrates a schematic and exploded diagram with partial sectional view of the first embodiment of the present invention.
Figure 2:
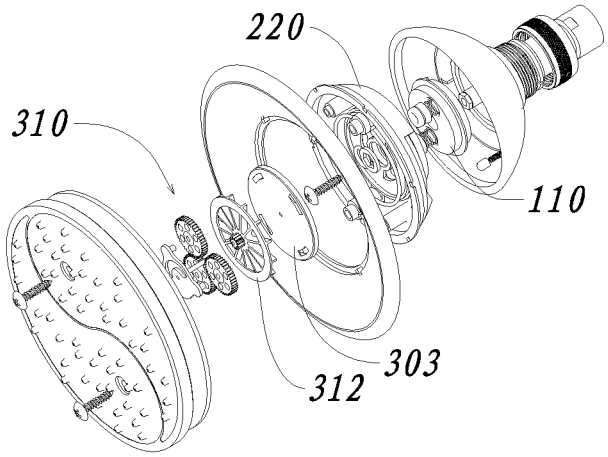
FIG. 2 illustrates a schematic and exploded diagram of the first embodiment.

The first embodiment: as figured in FIG. 1 and FIG. 2, a shower head with alternating outlet function has an inlet waterway 100 disposed at the top of the shower head, the inlet 101 thereof is at the screw portion the shower head is fixed; water from the inlet 101 flows from a ball head 103 to a diversion box 110, then flows out of an outlet 112, that is the entire waterway of the inlet waterway 100. With the diversion box 110, a single water flowing from the inlet 101 is discharging out according to the number of the outlets 112. In this embodiment, the terms 'up' and 'down' are defined as the flowing direction of the waterway, from 'up', otherwise 'down'.

An outlet terminal 200 is disposed in the lower end of the inlet waterway 100, the alternating inlets 301 and the synchronous inlets 215 of the water diversion plate 220 are switched alternately to connect to the outlet 112, resulting in two different waterways. The alternating inlets 301 and the synchronous inlets 215 are disposed at the top surface of the water diversion plate 220, and they are rotatably coupled to the outlet 112 on a plane. In addition, the synchronous inlets 215, the alternating inlets 301 at the top surface of the water diversion plate 220 and the outlet port 112 are rotatably symmetrical about the rotation shaft of the outlet port 112, as can be seen from the drawings, they are symmetrical about the rotation shaft right and left, so that the water diversion plate 220 is rotatable, the outlet port 112 is switched to alternating connect to the synchronous inlets 215 or alternating inlets 301, in particular, by rotating the water diversion plate 220, when the outlet port 112 is connected to the alternating inlets 301, the synchronous inlets 215 are relatively cut off and closed without any waterway therebetween, so that the waterway switch is clear and obvious without interference.

In the lower end of the waterway of the water diversion plate 200, there are an alternating cavity 300 and two rotatably symmetrical outlet cavities 210; the alternating cavity 300 and the outlet cavities 210 are coaxial and rotatably symmetrical. The outlet cavities 210 are flat rooms, they are mutually individual, a plurality of alternating inlet holes 213 are disposed in the center near the axis, the synchronous inlets 215 are disposed in the external periphery of the alternating inlet holes 213; the outlet cavity 210 is disposed with a plurality of outlet holes 211, which form the outlet surface of the shower head.

The upper end of the alternating cavity is disposed with the above mentioned alternating inlets 301, the interior thereof is disposed with a hydraulic alternating device 310, when the alternating inlets 301 are connected to the outlet port 112, water from outside impacts the hydraulic alternating device 310 inside the alternating cavity 300, so that the water alternately flows into the alternating inlet holes 213 below, at the same time, the synchronous inlets 215 connected to the outlet cavity 210 are cut off, so that the outlet cavity 210 is alternatively charging water, water just flows out of the outlet holes 211 alternatively, resulting in alternating outlet function. With this kind of structure, all outlet holes 211 are available to be set to synchronously outlets or alternatively outlets, the whole outlet surface is used to switch, the alternating effect is well, and it has strong pause effect when switching the waterways; the outlet cavity 210 is switched for synchronous outlet or alternating outlet, by rotating the outlet terminal 200 a certain angle despite of forward or backward, it is convenient and reliable. The water diversion plate 220 is applicable of many manners to couple to the outlet port 112, such as spherical sliding manner or parallel sliding manner, only if the function is guaranteed, when the alternating inlets 301 are connected to the outlet port 112, the synchronous inlets 215 are mutually separated. With above setting, the switching mechanism is simple, and from the drawings, although it is two outlet cavities 210 rotatably symmetrical in this embodiment, it can be expended to multiple outlet cavities 210 of rotatably symmetry, thus to realize multiple alternating waterways.

Figure 3:
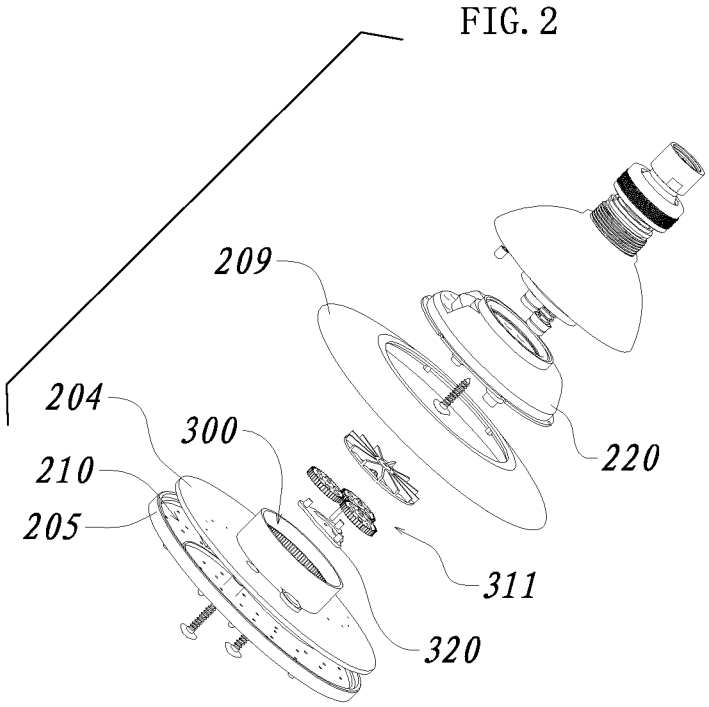
FIG. 3 illustrates another schematic and exploded diagram of the first embodiment from another view angle.
Figure 4:
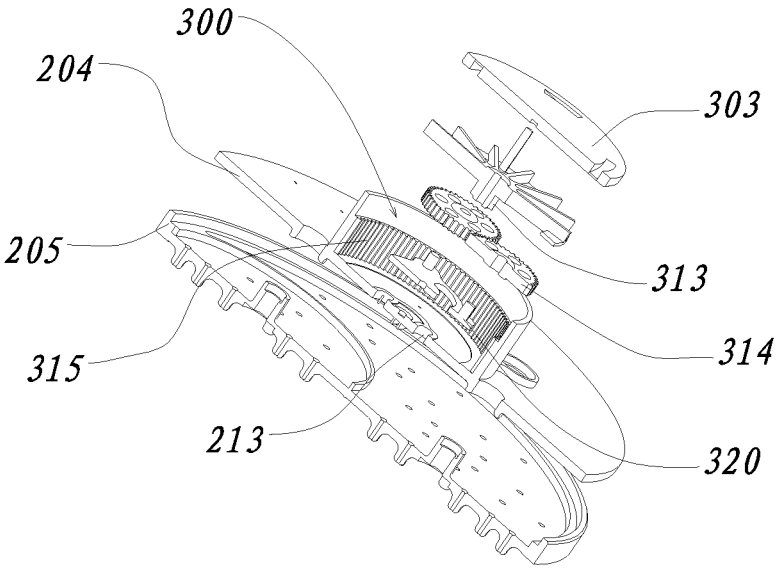
FIG. 4 illustrates an exploded diagram of the hydraulic alternating device of the first embodiment.

FIG. 3 is a schematic and exploded diagram of this embodiment of FIG. 1 in another view angle; FIG. 4 illustrates an exploded diagram of the hydraulic alternating device 310 of FIG. 1; combining FIG. 2, FIG. 3 and FIG. 4.

The outlet cavity 210 is mainly formed from a top cover 205 of the shower head and an upper cover 204 locked together, the alternating cavity 300 is formed above the upper cover 204; the upper cover 204 and the top cover 205 and the water diversion plate 220 are fixed together, a coaxial decorative cover 209 is fixed together as well.

The hydraulic alternating device 310 comprises a speed reducer 311, which is driven by a torsion force from water compacting the impeller 312. in FIG. 1, when water of outlet port 112 flows into the alternating inlets 301, it changes to a water flowing with circumference dynamic energy after passing through a inclined body 303, then it compacts the impeller 312 to rotate.

The speed reducer 311 is a planetary gear train. As seen from FIG. 4, the lower end of the impeller 312 is fixed with a coaxial sun gear 313, centering about the sun gear 313, there are three planetary gears 314 symmetrically engaging to the sun gear 313, the external periphery of the sun gear 314 is disposed with a gear frame 315, the gear frame 315 with an internal annular gear is fixed to the internal wall of the alternating cavity. 300; the rotation shafts of the three planetary gears 314 are disposed in a water stop blade 320. so that a high speed rotation of the sun gear 313 transverses to a low speed rotation of the water stop blade 320, the water stop blade 320 is slidably coupled to the alternating inlet holes 213, when the water stop blade rotates, the alternating inlet holes 213 are alternately connected to the alternating cavity 300. with the advantage of the planetary gear train to reduce speed, the hydraulic alternating device 310 is quiet, stably rotatable and with stable torque, particularly, the alternating inlet holes 213 are centered on the center of the upper cover 204 and the top cover 205, the water stop blade 320 is available with small torque to alternately switch, the device is compact structural, the alternating pressure is reasonable and stable.

Figure 5:
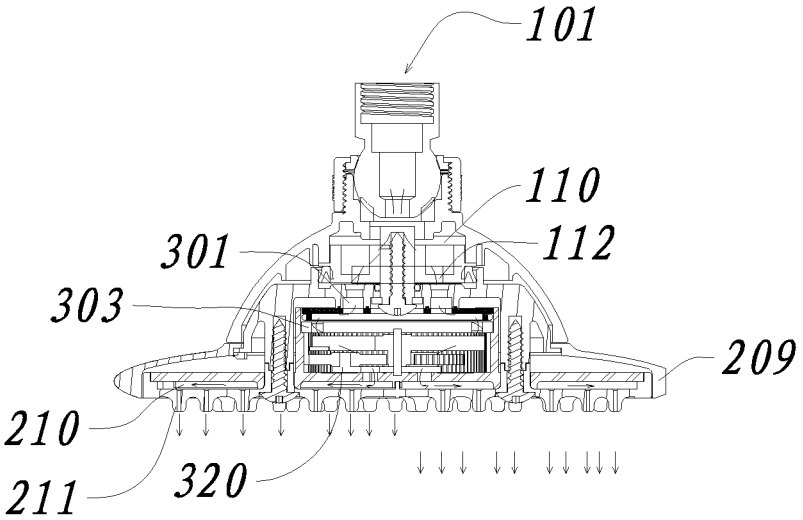
FIG. 5 illustrates a sectional view of the first embodiment in alternating working.
Figure 6:
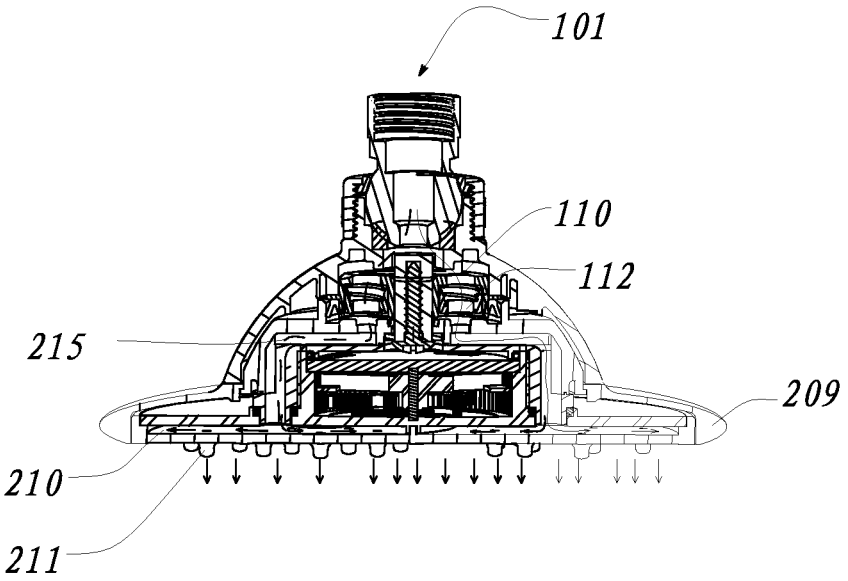
FIG. 6 illustrates a sectional view of the first embodiment in normal working.

FIG. 5 is a sectional view of FIG. 1 in alternating outlet condition; FIG. 6 is a sectional view of FIG. 1 in normal working condition. The working condition of this embodiment will be further described combined with the two drawings.

In FIG. 5, water from the inlet port 101 flows through the water diversion box 110, then flows out of the outlet port 112, the outlet port 112 is connected to the alternating outlet 301, so that water flows through the inclined body 303, with the stop work of the rotating water stop blade 320, water alternately enters into the two outlet cavities 210, so that water is divided into two parts alternating discharging out from the outlet holes 211 of the outlet surface of the shower head, thus making it a massage water flowing with pause effect; FIG. 6 is based on the FIG. 5, rotating by holding the decorative cover, the synchronous inlets 215 are connected to the outlet port 112, as the synchronous inlets 215 are kept to connect to the outlet cavity 210 synchronously, water from the inlet port 101 is non-blocked flowing out of all outlet holes 211, thus realizing the basic function of a shower head. As can be seen, the structure of switch is simple, the operation is convenient.

Figure 7:
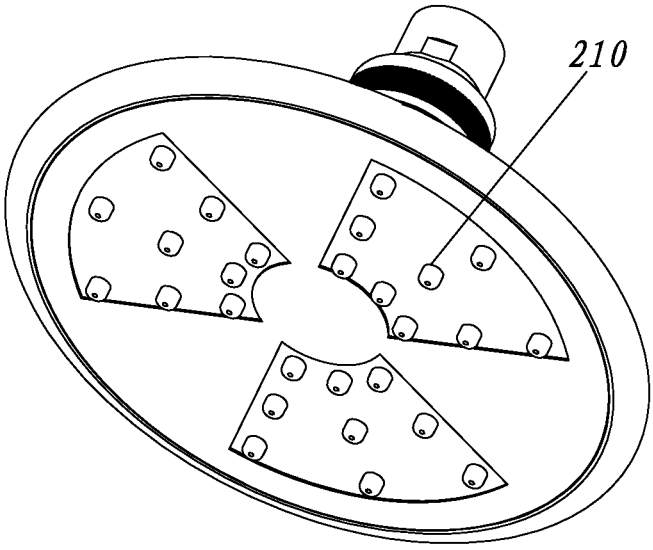
FIG. 7 illustrates a schematic diagram of the second embodiment.

The second embodiment: as figured in FIG. 7, disclosed is a shower head with alternating outlet function, the difference from the first embodiment is that: it comprises three outlet cavities 210, the synchronous inlets 215 thereof are distributed in the external periphery of the alternating inlet holes 213 in circumference, three outlet areas are correspondingly disposed (refer to FIG. 1).

Figure 8:
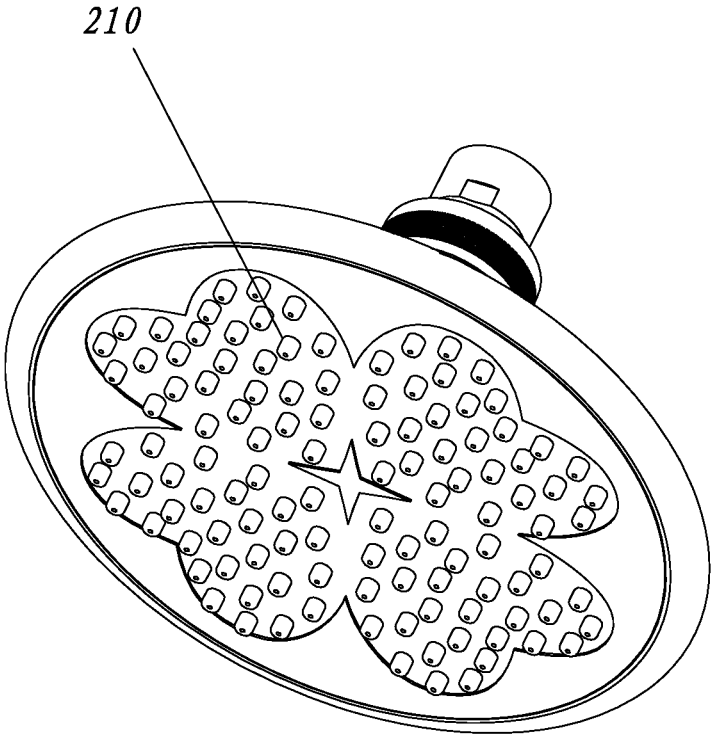
FIG. 8 illustrates a schematic diagram of the third embodiment.

The third embodiment: as figured in FIG. 8, disclosed is a shower head with alternating outlet function, the difference from the first embodiment is that: it comprises four outlet cavities 210, the synchronous inlets 215 thereof are distributed in the external periphery of the alternating inlet holes 213 in circumference, four outlet areas are correspondingly disposed (refer to FIG. 1).

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a shower head with alternating outlet function, which realizes an alternating function that the outlet holes of the whole shower head are alternatively switched; the switch of the waterways are mutually individual, the water flowing has strong pause effect. In addition, it has simple structure and less components; the structure is easy to expend the alternating units.

The invention claimed is:

1. A shower head with alternating outlet function, wherein comprising:

an inlet waterway, comprising an inlet port, an outlet port and an entire waterway therebetween;

an outlet terminal, having at least two outlet cavities, the outlet cavities are rotatably distributed on a plane and being mutually independent, and the outlet cavities have outlet holes, alternating inlet holes and synchronous inlets; the outlet holes are disposed on an outlet surface of the shower head; and an alternating cavity with alternating inlets, fixed to the outlet terminal; the alternating cavity is connected to all alternating inlet holes; the interior thereof is disposed with a hydraulic alternating device to make the alternating inlets to connect to the alternating inlet holes in alternating manner driven by water pressure;

the synchronous inlets and the alternating inlets are switched to connect to the outlet port by rotating a water diversion plate;

the water diversion plate has a structure that when the alternating inlets are connected to the outlet port, the synchronous inlets are mutually separated and sealed, wherein the hydraulic alternating device comprising an impeller rotating by the impact of the flow-in water from the alternating inlets, the impeller is alternately coupled to the inlet holes of the outlet cavities by a speed reducer driving a water stop blade to rotate, the speed reducer including a planetary gear train, the planetary gear train including:

a sun gear fixed to the central shaft of the impeller;

three planetary gears engaged to the external periphery of the sun gear uniformly, rotation shafts of the three planetary gears disposed to the water stop blade, and a gear frame with an internal annular gear, engaged to the external peripheries of all gears, the gear frame fixed to the internal wall of the alternating cavity.

2. The shower head with alternating outlet function according to claim 1, wherein the water diversion plate is rotatably coupled to the outlet port.

3. The shower head with alternating outlet function according to claim 2, wherein the synchronous inlets and the alternating inlets are located on an top surface of the water diversion plate, the top surface is slidably coupled to the outlet port.

4. The shower head with alternating outlet function according to claim 2, wherein the synchronous inlets and the alternating inlets are distributed on a same revolution surface in circumference, the synchronous inlet, the alternating inlets and the outlet port are rotatably symmetrical about the rotation axis of the outlet port.

5. The shower head with alternating outlet function according to claim 2, wherein the outlet cavities are rotatably symmetrical; the alternating cavity, the water diversion plate and the outlet cavities are coaxial.

6. The shower head with alternating outlet function according to claim 5, wherein the alternating inlet holes of the outlet cavities are centered on the central shaft thereof; the synchronous inlets of the outlet cavities are distributed in the external periphery of the alternating inlet holes in circumference.

7. The shower head with alternating outlet function according to claim 6, wherein comprising two outlet cavities, the synchronous inlets thereof are distributed in the external periphery of the alternating inlet holes in circumference, two outlet areas correspondingly disposed.

8. The shower head with alternating outlet function according to claim 6, wherein comprising three outlet cavities, the synchronous inlets thereof are distributed in the external periphery of the alternating inlet holes in circumference, three outlet areas are correspondingly disposed.

9. The shower head with alternating outlet function according to claim 6, wherein comprising four outlet cavities, the synchronous inlets thereof are distributed in the external periphery of the alternating inlet holes in circumference, four outlet areas are correspondingly disposed.

* * * * *